US008393782B2

(12) United States Patent
Smith

(10) Patent No.: US 8,393,782 B2
(45) Date of Patent: Mar. 12, 2013

(54) MOTIONLESS MIXING DEVICE HAVING PRIMARY AND SECONDARY FEED PORTS

(76) Inventor: Robert S. Smith, Seal Beach, CA (US)

( * ) Notice: Subject to any disclaimer, the term of this patent is extended or adjusted under 35 U.S.C. 154(b) by 381 days.

(21) Appl. No.: 12/836,857

(22) Filed: Jul. 15, 2010

(65) Prior Publication Data

US 2012/0014209 A1 Jan. 19, 2012

(51) Int. Cl.
*B01F 5/06* (2006.01)

(52) U.S. Cl. ..... 366/181.5; 366/337

(58) Field of Classification Search ..... 366/181.5, 366/336–340; 138/40, 42, 44
See application file for complete search history.

(56) References Cited

U.S. PATENT DOCUMENTS

| | | | | | |
|---|---|---|---|---|---|
| 2,816,518 | A | * | 12/1957 | Daggett | 222/145.6 |
| 3,923,288 | A | * | 12/1975 | King | 366/336 |
| 4,034,965 | A | * | 7/1977 | King | 366/336 |
| 4,050,676 | A | * | 9/1977 | Morishima et al. | 366/339 |
| 4,208,136 | A | * | 6/1980 | King | 366/338 |
| 4,213,712 | A | * | 7/1980 | Aanonsen et al. | 366/168.2 |
| 4,441,823 | A | * | 4/1984 | Power | 366/167.1 |
| 4,487,510 | A | * | 12/1984 | Buurman et al. | 366/337 |
| 4,614,440 | A | * | 9/1986 | King | 366/336 |
| 4,616,937 | A | * | 10/1986 | King | 366/336 |
| 4,643,584 | A | * | 2/1987 | Allocca | 366/337 |
| 4,674,888 | A | * | 6/1987 | Carlson | 366/337 |
| 4,753,535 | A | * | 6/1988 | King | 366/337 |
| 4,793,713 | A | * | 12/1988 | King | 366/181.8 |
| 4,808,007 | A | * | 2/1989 | King | 366/337 |
| 4,886,368 | A | * | 12/1989 | King | 366/155.1 |
| 5,176,448 | A | * | 1/1993 | King et al. | 366/174.1 |
| 5,388,906 | A | * | 2/1995 | Rao | 366/173.2 |
| 5,484,203 | A | * | 1/1996 | King et al. | 366/337 |
| 5,511,877 | A | * | 4/1996 | King | 366/169.2 |
| 5,522,661 | A | * | 6/1996 | Tsukada | 366/337 |
| 5,605,399 | A | * | 2/1997 | King | 366/337 |
| 5,758,967 | A | * | 6/1998 | King | 366/337 |
| 5,865,537 | A | * | 2/1999 | Streiff et al. | 366/174.1 |
| 5,947,597 | A | * | 9/1999 | King | 366/181.5 |
| 6,024,842 | A | * | 2/2000 | King | 203/99 |
| 6,027,241 | A | * | 2/2000 | King | 366/181.5 |
| 6,082,713 | A | * | 7/2000 | King | 261/79.2 |
| 6,102,561 | A | * | 8/2000 | King | 366/181.5 |
| 6,132,079 | A | * | 10/2000 | King | 366/181.5 |
| 6,276,823 | B1 | * | 8/2001 | King | 366/181.5 |
| 6,488,402 | B1 | * | 12/2002 | King et al. | 366/173.2 |

(Continued)

FOREIGN PATENT DOCUMENTS

| | | | | |
|---|---|---|---|---|
| GB | 2015360 | A | * | 9/1979 |
| JP | 62149326 | A | * | 7/1987 |

*Primary Examiner* — Charles E Cooley
(74) *Attorney, Agent, or Firm* — Bay Area Technology Law Group

(57) ABSTRACT

A high efficiency mixing device for mixing first and second fluids within a conduit. A biscuit element is positioned at the upstream end of the conduit having a longitudinal axis that coincides with the longitudinal axis of the conduit. The biscuit element is provided with a plurality of openings including a central opening positioned along the longitudinal axis and a plurality of additional openings spaced proximate to the central opening. The openings are provided with primary mixing elements which induce a rotational angular velocity to a first fluid passing therethrough of the same rotational sign. Second fluid feed ports are positioned within each of the openings for introducing a second fluid to the first fluid as the first fluid passes through the openings and into the conduit. Secondary and tertiary mixing elements are optionally located downstream of the biscuit element to enhance the mixing of the first and second fluids.

9 Claims, 1 Drawing Sheet

U.S. PATENT DOCUMENTS 6,540,393 B1 * 4/2003 Lyons et al. ..... 366/181.5
6,740,198 B2 * 5/2004 Ahola et al. ..... 162/57
7,137,731 B2 * 11/2006 Carlson ..... 366/337
7,503,686 B2 * 3/2009 Tarmann et al. ..... 366/173.1
8,136,980 B2 * 3/2012 Smith ..... 366/337
2005/0219947 A1 * 10/2005 Carlson ..... 366/337
2008/0037366 A1 * 2/2008 Smith ..... 366/337
2012/0014209 A1 * 1/2012 Smith ..... 366/340
2012/0188842 A1 * 7/2012 Smith ..... 366/150.1

* cited by examiner

MOTIONLESS MIXING DEVICE HAVING PRIMARY AND SECONDARY FEED PORTS

TECHNICAL FIELD

The present invention deals with an enhanced material mixing apparatus which contains various elements traditionally known as static mixers for mixing components of a fluid stream. The enhanced mixing device can be used with liquids as well as gases and provides for a robust mixing protocol in a relatively short conduit length.

BACKGROUND OF THE INVENTION

It has long been realized that static mixers, if made to work efficiently, provide certain economical advantages over dynamic mixers for, as the name implies, static mixers employ no moving parts. As such, static devices are generally less expensive to configure and certainly much less expensive to maintain while providing the user with an extended useful life for the mixer product in service.

Prior art approaches to static mixers have generally involved expensive machining, molding, casting or other fabrication of the component mixer elements coupled with some type of permanent attachment between elements and a conduit and/or between elements within a conduit. The resulting costs and difficulty of manufacturing result in a relatively expensive end product. Moreover, many of the prior mixers provide less than complete mixing, particularly with respect to material flow along the walls of the conduit. This so called "wall smearing" is related to the parabolic velocity profile of a fluid in laminar flow with a fluid velocity approaching zero along the wall surfaces.

A marked improvement in static mixer technology was represented by the teachings of U.S. Pat. No. 3,923,288. The invention embodied in the cited patent was taught to be a stationary material mixing apparatus comprised of a plurality of self-nesting, abutting and axially overlapping elements which are fit into a conduit. Each region of axial overlap between elements provides a mixing matrix introducing complex velocity vectors into the materials. The mixing elements claimed in U.S. Pat. No. 3,923,288, the disclosure which is incorporated by reference, includes a flat central portion and first and second ears rounded or otherwise configured at their outside peripheries to fit within a conduit or within a cylindrical space. Such mixing elements induce a rotational angular velocity to fluids passing through them and when used with similar mixing elements can induce appropriate mixing as fluid streams interact with one another in a shearing matrix. In the case of a single input stream into an assembly of "n" such mixing elements, one obtains $2^n$ divisions of the stream. This is so because each mixing element involves a 2×2 division of the flow stream.

A device capable of increasing the mixing efficiency of mixing elements such as those disclosed in the cited prior art to something greater than $2^n$ divisions was disclosed in U.S. Pat. No. 4,614,440. In its broadest terms, the cited '440 patent taught a stationary material mixing apparatus for mixing a fluid stream which is in a shape of a conduit comprising individual biscuit sections. The sections were aligned along a common longitudinal axis, while each biscuit section comprised a plurality of openings therethrough, where within each of the openings were located mixing elements which induce the appropriate rotational angular velocity to the fluid stream. Substantially all of the mixing elements were taught to induce the same rotational side to the fluid noting that openings in adjacent biscuit sections were purposely misaligned to enhance the mixing operation.

It has now been determined that a much more highly efficient motionless mixing assembly can be fabricated within an appropriate conduit to increase mixing efficiencies well beyond those of the prior art.

These and further objects will be more readily apparent when considering the following disclosure and appended claims.

SUMMARY OF THE INVENTION

A high efficiency mixing device for mixing first and second fluids within a conduit. A biscuit element is positioned at the upstream end of the conduit having a longitudinal axis that coincides with the longitudinal axis of the conduit. The biscuit element is provided with a plurality of openings including a central opening positioned along the longitudinal axis and a plurality of additional openings spaced proximate to the central opening. At least the additional openings and ideally the central opening as well are provided with primary mixing elements which induce a rotational angular velocity to a first fluid passing therethrough. As a preferred embodiment the mixing elements induce the same rotational sign to the fluid passing therethrough. Second fluid feed ports are positioned within each of the additional openings and preferably within all openings for introducing a second fluid to the first fluid as the first fluid passes through the openings and into the conduit. This provides parallel paths of fluids within the conduit enhancing the mixing process.

In addition, the biscuit element referred to above can be joined with a plurality of secondary mixing elements appended to the inner wall of the conduit. These secondary mixing elements have no edges perpendicular to the longitudinal axis and are sized and positioned within the conduit so that at any plane passing perpendicularly to the longitudinal axis, the conduit is free of any secondary mixing elements at the longitudinal axis and no secondary mixing elements are in contact with one another. As yet a further preferred embodiment, the biscuit element discussed above can be joined together with the secondary mixing elements and tertiary mixing elements comprising one or more pairs of splayed baffles connected to one another at the longitudinal axis.

DETAILED DESCRIPTION OF THE INVENTION

Figure 1:
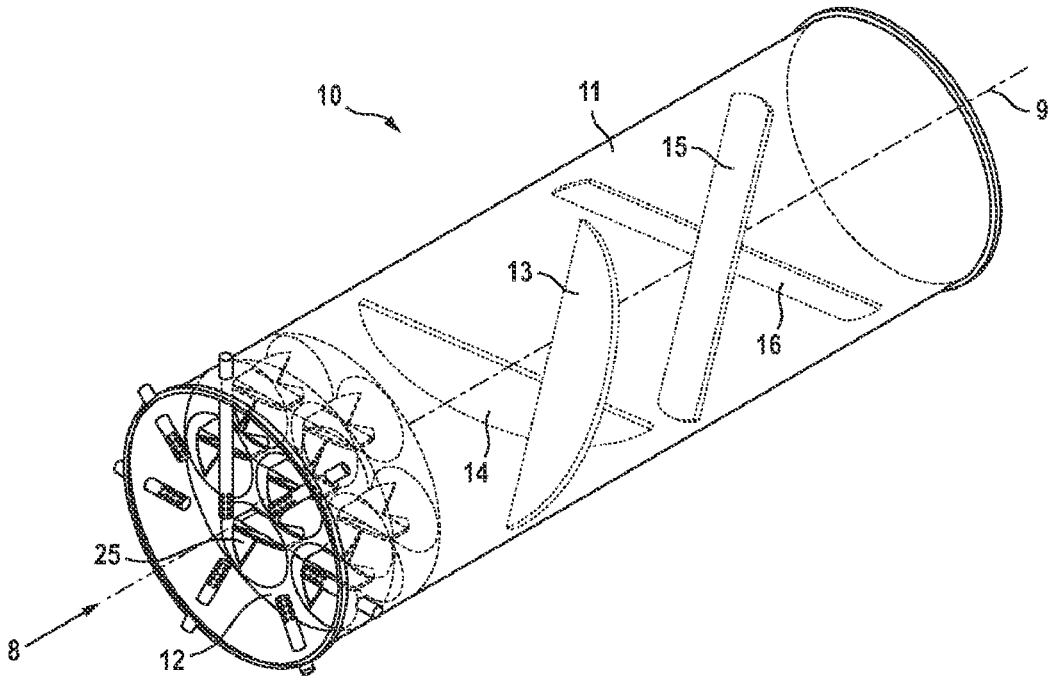
FIG. 1 is a perspective view of a conduit embodying the various mixing elements of the present invention.

Novel features which are characteristic of the invention, as to organization and method of operation, together with further objects and advantages thereof will be better understood from the following description considered in connection with the accompanying drawings, in which preferred embodiments in the invention are illustrated by way of example. It is to be expressly understood, however, that the drawings are for the illustration description only and are not intended as definitions of the limits of the invention. The various features of novelty which characterize the invention are recited with particularity in the claims.

There has been broadly outlined more important features of the invention in the summary above and in order that the detailed description which follows may be better understood, and in order that the present contribution to the art may be appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to directions in the drawings to which reference is made unless otherwise stated. Similar words such as "inward" and "outward" refer to directions toward and away from, respectively, the geometric center of a device or area and designated parts thereof. Reference in the singular tense include the plural and vice versa, unless otherwise noted.

Turning first to FIG. 1, the various component parts of the present invention are shown as element 10 including conduit 11. Conduit 11 is shown as being substantially cylindrical having a substantially circular cross section and longitudinal axis 9 along its geometric center.

Biscuit element 12 is positioned within conduit 11 noting that fluid passing within conduit 11 would be traveling in the direction of arrow 8 from left to right as shown in the drawing. Thus, biscuit element 12 is located at the upstream end of conduit 11 with respect to other mixing elements incorporated as preferred embodiments in practicing the present invention.

Figure 2:
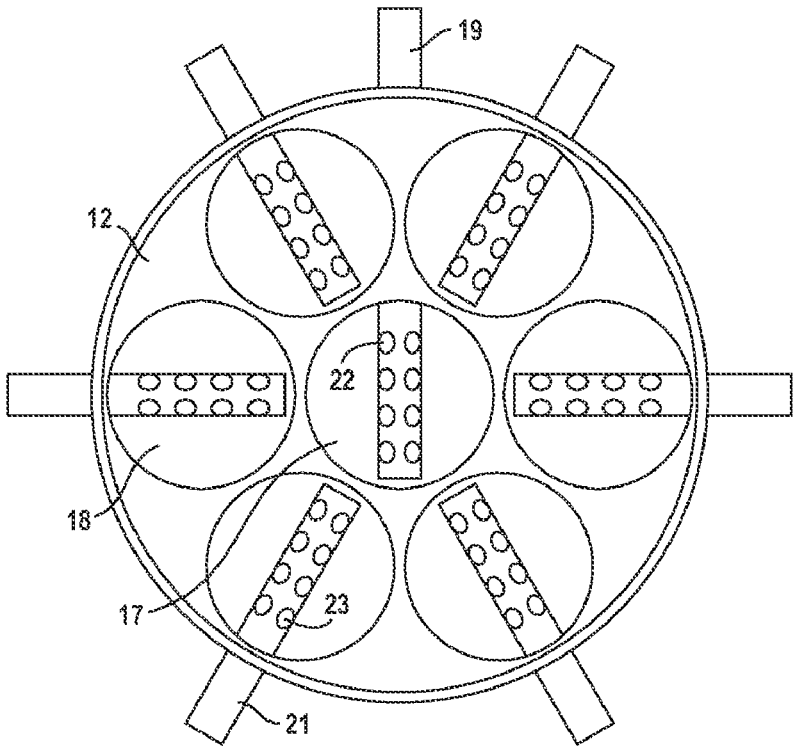
FIG. 2 is a font view of a biscuit mixing element depicting its various component parts.

Biscuit element 12 is also provided with a longitudinal axis which is coincident with longitudinal axis 9 of conduit 11. Biscuit element 12 is provided with a plurality of openings 17, 18, etc., as best seen in reference to FIG. 2.

As its preferred embodiment, biscuit element 12 is configured with central opening 17 located along longitudinal axis 9 and a plurality of peripheral openings 18 proximate centrally located opening 17. An ideal configuration is shown in the present figures whereby surrounding central opening 17 are a hexagonal array of openings 18 located between central opening 17 and the periphery of biscuit element 12. Further, each of said openings are preferably circular in cross section having a longitudinal axis parallel to longitudinal axis 9. It is noted, however, that central opening 17 can be partially or even totally blocked while remaining within the spirit and scope of the present invention.

In each of the openings 18, and preferably also within opening 17, are located a mixing element such as taught in U.S. Pat. No. 3,923,288. Each of these mixing elements induces a rotational angular velocity to the fluid passing therethrough. Ideally, each mixing element induces a rotation angular velocity of the same sign. This creates rotational vortexes that impinge on each other greatly facilitating mixing.

A further feature of the present invention involves the way in which a second fluid, to be mixed with the first, is introduced to the mixing process. In this regard, reference again is made to FIG. 2 showing second fluid feed tubes 19, 21, etc having openings 22 and 23, respectively, creating entry ports at each of the openings in biscuit 12 for the introduction of the second fluid to the first fluid as the first fluid passes in the direction of arrow 8. Each of the secondary feed tubes 21 feed the second fluid into peripheral openings 18 while central opening 17 can be devoid of feed tube 19 while remaining within the spirit and scope of the present invention. By the time the first and second fluids are acted upon by primary mixing elements 25, a significant degree of mixing has occurred. However, mixing can be yet further enhanced by providing additional mixing elements downstream of biscuit 12. In this regard, reference is again made to FIG. 1.

Downstream of biscuit element 12 within conduit 11 is located a plurality of secondary mixing elements 13 and 14 appended to the inner wall of conduit 11. Secondary mixing elements 13 and 14 are characterized as having no edges or surfaces perpendicular to longitudinal axis 9 and are sized so that no such elements are in contact with one another resulting in an open region of travel for fluids passing through conduit 11 in the direction of arrow 8 along longitudinal axis 9. Such mixing elements were first disclosed by the present assignee in its U.S. Pat. No. 5,758,967. Elements 13 and 14 were taught to be useful in mixing various fluids such as gases, liquids and even solids as well as combinations of such materials. The genesis for the design and creation of mixing elements 13 and 14 is a result of activities conducted in the sewage treatment field. Such mixers are used to combine dewatering agents with sewage flow just upstream of a filter press. Elements 13 and 14 were created to provide a clog free environment facilitating sewage treatment while eliminating low pressure or "dead spots" which, if present, would trap long fibers and eventually clog the conduit. Ideally, mixing elements 13 and 14 are provided in pairs, each complimentary pair causing flowing material to rotate about the axis of a conduit in opposite directions.

As a farther preferred embodiment, downstream of secondary mixing elements 13 and 14 are located a plurality of tertiary mixing elements 15 and 16. Tertiary mixing elements 15 and 16 comprise at least one pair of splayed baffles connected to one another at longitudinal axis 9. Tertiary mixing elements 15 and 16 are particularly effective when used in conjunction with secondary mixing elements 13 and 14. Where secondary mixing elements 13 and 14 move fluids away from the inner wall of conduit 11, tertiary mixing elements 15 and 16 force moving fluid toward the pipe wall assuring good cross-pipe mixing. This, in combination with biscuit element 12 which creates initial localized mixing, provides a high efficiency mixer suitable for a wide variety of fluids.

The above disclosure is sufficient to enable one of ordinary skill in the art to practice the invention, and provides the best mode of practicing the invention presently contemplated by the inventor. While there is provided herein a full and complete disclosure of the preferred embodiments of the invention, it is not desired to limit the invention to the exact construction, dimensions, relationships, or operations as described. Various modifications, alternative constructions, and changes in equivalence will readily occur to those skilled in the art and may be employed as suitable, without departing from the true spirit and scope of the invention. Such changes might involve alternative materials, components, structural arrangements, sizes, shapes, forms, functions, operational features or the like. Therefore, the present description and illustrations should not be considered as limiting the scope of the invention, which is defined by the appended claims.

What is claimed is:

1. A high efficiency mixing device for mixing first and second fluids within a conduit, said conduit being substantially cylindrical having a substantially circular cross section and longitudinal axis along its geometric center, a biscuit element having a longitudinal axis coinciding with the longitudinal axis of said conduit, said biscuit element having a plurality of openings comprising a central opening positioned along said longitudinal axis and a plurality of peripheral openings spaced proximate said central opening, each peripheral opening having a primary mixing element located therein, all primary mixing elements inducing a rotational angular velocity to said first fluid passing therethrough and positioning second fluid feed ports proximate and upstream of each of said peripheral openings for the introduction of said second fluid to said first fluid as said first fluid passes through said openings and into said conduit.

2. The high efficiency mixing device of claim 1 wherein each of said openings in said biscuit element is substantially circular in cross section having a longitudinal axis that is substantially parallel to the longitudinal axis of said conduit.

3. The high efficiency mixing device of claim 1 further comprising a plurality of secondary mixing elements appended to the inner wall of said conduit, said secondary mixing elements having no edges perpendicular to said longitudinal axis and sized and positioned within said conduit such that at any plane passing perpendicularly to said longitudinal axis, said conduit is free of any secondary mixing elements at its longitudinal axis and no secondary mixing elements are in contact with one another.

4. The high efficiency mixing device of claim 1 further comprising a plurality of tertiary mixing elements downstream of said biscuit element, said tertiary mixing elements comprising a pair of splayed baffles connected to one another at said longitudinal axis.

5. The high efficiency mixing device of claim 1 wherein all primary mixing elements induce the same rotational sign to the fluids passing through said peripheral openings.

6. The high efficiency mixing device of claim 1 wherein a primary mixing device is also positioned within said central opening.

7. The high efficiency mixing device of claim 1 wherein a secondary feed port is located proximate and upstream of said central opening.

8. A high efficiency mixing device for mixing first and second fluids within a conduit, said conduit being substantially cylindrical having a substantially circular cross section and longitudinal axis along its geometric center, a biscuit element having a longitudinal axis coinciding with the longitudinal axis of said conduit, said biscuit element having a plurality of openings comprising a central opening positioned along said longitudinal axis and a plurality of additional openings spaced proximate said central opening, each opening having a primary mixing element located therein, all primary mixing elements inducing a rotational angular velocity to said first fluid passing therethrough of the same rotational sign and positioning second fluid feed ports proximate and upstream of each of said openings for introducing said second fluid to said first fluid as said first fluid passes through said openings and into said conduit, a plurality of secondary mixing elements located downstream of said biscuit for receiving first and second fluids passing therethrough, said secondary mixing elements appended to the inner wall of said conduit, said secondary mixing elements having no edges perpendicular to said longitudinal axis and sized and positioned within said conduit such that at any plane passing perpendicularly to said longitudinal axis, said conduit is free of any secondary mixing elements at its longitudinal axis and no secondary mixing elements are in contact with one another and further comprising a plurality of tertiary mixing elements also located downstream of said biscuit element, said tertiary mixing elements comprising a pair of splayed baffles connected to one another at said longitudinal axis.

9. A method of mixing first and second fluids through the use of a high efficiency mixing device within a conduit, said conduit having an upstream end and downstream end, a circular cross section and longitudinal axis along its geometric center, a biscuit element located proximate the upstream end of the conduit, said biscuit element having a longitudinal axis coinciding with the longitudinal axis of said conduit, said biscuit element having a plurality of openings comprising a central opening positioned along said longitudinal axis and a plurality of additional openings spaced proximate said central opening, each opening having a primary mixing element located therein, all primary mixing elements inducing a rotational angular velocity to said first fluid, introducing said first fluid to said openings causing said first fluid to assume a rotational angular velocity as it passes through each opening of the same rotational sign, positioning second fluid feed ports proximate and upstream of each of said openings and introducing said second fluid within each of said openings for mixing with said first fluid, passing said first and second fluids downstream of said biscuit element to a plurality of secondary mixing elements appended to the inner wall of said conduit, said secondary mixing elements having no edges perpendicular to said longitudinal axis and sized and positioned within said conduit such that at any plane passing perpendicularly to said longitudinal axis, said conduit is free of any secondary mixing elements at its longitudinal axis and no secondary mixing elements are in contact with one another, said first and second fluids thereupon contacting a plurality of tertiary mixing elements also located downstream of said biscuit element, said tertiary mixing elements comprising a pair of splayed baffles connected to one another at said longitudinal axis.

* * * * *